US006271183B1

(12) United States Patent
Hewson

(10) Patent No.: US 6,271,183 B1
(45) Date of Patent: Aug. 7, 2001

(54) EMULSIFIABLE CUTTING OIL THAT MINIMIZES GRAPHITE PASTE FORMATION WHEN CUTTING GRAPHITE CONTAINING METALS

(75) Inventor: William Donald Hewson, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/512,872

(22) Filed: Feb. 25, 2000

(51) Int. Cl.[7] ..... C10M 101/02; C10M 129/06; C10M 141/08

(52) U.S. Cl. ..... 508/416; 508/532; 508/583

(58) Field of Search ..... 508/416, 532, 508/583

(56) References Cited

U.S. PATENT DOCUMENTS 3,719,598 * 3/1973 King .
4,849,122 * 7/1989 Imai et al. .
5,171,903 * 12/1992 Koyama et al. .
5,817,605 * 10/1998 Papay .
6,063,261 * 5/2000 Baca .

* cited by examiner

*Primary Examiner*—Jerry D. Johnson
(74) *Attorney, Agent, or Firm*—Joseph J. Allocca

(57) ABSTRACT

An emulsifiable oil composition for machining graphite containing metals comprises a major amount of an oil of lubricating viscosity; at least one surfactant in an amount sufficient to render the oil emulsifiable in water; and, from about 0.8 vol % to about 3 vol % based on the total volume of the composition of an aliphatic alcohol having from 1 to about 8 carbon atoms.

9 Claims, No Drawings

EMULSIFIABLE CUTTING OIL THAT MINIMIZES GRAPHITE PASTE FORMATION WHEN CUTTING GRAPHITE CONTAINING METALS

FIELD OF INVENTION

The present invention relates generally to emulsifiable oils used in metal working and more particularly to improvements in emulsifiable oils used in machining graphite containing metals, especially cast iron.

BACKGROUND OF INVENTION

Gray and malleable cast iron typically contain between about 2 to about 5 wt % carbon as graphite. In fact, gray cast iron is so-called because when it is fractured the exposed interior surface is gray in color due to the graphite.

In machining metal parts a lubricating composition normally is used to serve not only as a lubricant but also as a coolant and to promote tool cleanliness. Conventional water mix lubricating compositions used in metal cooling consist of a base oil such as a petroleum basestock, a surfactant system, a corrosion inhibition system and a biocidal system. In use, the lubricating composition is mixed with water in the range of about 2 vol % to about 20 vol % oil to form an oil-in-water emulsion.

Experience has shown that in machining cast iron, such as gray cast iron, small particles of graphite are released into the emulsion and result in the formation of a black paste in the oil phase which not only is difficult to clean up but tends to foul the machine tool. This causes long machine tool downtime for tool changes and maintenance. Thus, there is a need for an emulsifiable lubricating composition which tends to reduce, if not prevent, graphite paste formation when the composition is used in machining graphite containing metals such as of cast iron.

SUMMARY OF INVENTION

Accordingly, in one embodiment an emulsifiable lubricating oil composition for use in machining graphite containing metals comprises a major amount of a paraffmic oil of lubricating viscosity, at least one surfactant in an amount sufficient to render the oil emulsifiable in water and from about 0.8 vol % to about 3 vol % of an aliphatic alcohol having from 1 to about 8 carbon atoms.

DETAILED DESCRIPTION

The emulsifiable lubricating oil composition of the present invention includes a major amount of a paraffinic oil of lubricating viscosity. Preferably the paraffinic oil is a basestock having the properties shown in Table 1.

TABLE 1

| | Broad Range | Preferred Range |
|---|---|---|
| KV @ 40° C. cSt | 7–100 | 20–25 |
| KV @ 100° C. cSt | 2–12 | 3–6 |
| KV @ 100° F. SUS | 50–470 | 90–120 |
| Viscosity Index | 45–100 | 75–90 |
| Pour Point, ° C. | −50 to +9 | −20 to −9 |
| Flash Point COC, ° C. | 150–300 | 190–220 |

The composition of the present invention includes at least one surfactant, and may include a mixture of surfactants, in an amount sufficient to render the oil emulsifiable in water. Suitable surfactants are those typically used in emulsifiable oils for metal working such as alkali metal sulfonate and napthanates, fatty acids and the like. Especially preferred is a mixed sulfonate and naphthenate emulsion system with added fatty acid. Typically the surfactant or mixture of surfactants will be present in an amount ranging from about 12 vol % to about 26 vol % based on the total volume of the composition.

Importantly, the compositions of this invention include from about 0.8 vol % to about 3 vol %, based on the total volume of the composition, of an aliphatic alcohol having 1 to about 8 carbon atoms. Isopropanol is particularly preferred.

The composition of the present invention may also include biocidal agents and antifoamants.

Table 2 sets forth several especially useful compositions in accord with the invention.

TABLE 2

| Component | Vol % Range | Vol % Preferred |
|---|---|---|
| 100 P Base Oil[1] | 30–96 | 81.80 |
| Surfactant[2] | 12–25 | 15.75 |
| Surfactant[3] | 0.05–1.0 | 0.50 |
| Antifoamant[4] | 0.01–1.0 | 0.60 |
| Isopropanol | 0.3 to 3.0 | 1.35 |

[1]A paraffinic lubricating base oil having KV @ 40° C. of 22 cSt.
[2]A mixed sulfonate and naphthenate emulsion system sold under the name Polartech 6090P/M0085 by Polartech, Dundas, Ontario, Canada.
[3]A tall oil fatty acid sold under the name Pamak 4 by Hercules Corp., Wilmington, Delaware.
[4]An ethylene bis-stearamide antifoamant sold under the name Discotech 5898 by Calloway Chemical, Columbus, Georgia.

EXAMPLE

Two compositions were prepared as set forth in Table 3 and the properties set forth in Table 3 were determined.

TABLE 3

| | Example 1 | Example 2 |
|---|---|---|
| Components | | |
| IOL 100P Base | 81.77 | 81.78 |
| Polartech 6090P | 15.77 | 15.77 |
| Discotech 598 | 0.59 | 0.59 |
| Isopropanol | 1.38 | 1.37 |
| Pamak C-4 | 0.49 | 0.49 |
| Total | 100.00 | 100.00 |
| Inspections | | |
| KV 40° C. St ASTM D445 | 34.78 | 35.58 |
| Emulsion Stability | <2.0 ml cream | <2.0 ml cream |
| Foaming Tendency | 1 | 1 |
| Emulsion pH | 9.01 | 9.30 |
| Freeze Thaw | Pass | Pass |
| Elevated Temperature | Pass | Pass |
| Flash COC, ° C. ASTM D92 | NA | 124 |

NA = Not Available

In a series of runs these compositions were mixed with 90 to 84 vol % water and tested in a metal working machine that cuts internal threads on malleable cast iron pipe and external threads on solid malleable cast iron plugs. The emulsified lubricant operated well and no problems of sticking were observed whereas sticking and silt formations were observed with other lubricants.

What is claimed is:

1. An emulsifiable oil composition for machining graphite containing metals comprising:

a major amount of a base oil consisting of a paraffinic oil of lubricating viscosity;

at least one surfactant selected from the group consisting of sulfonates, naphthenates and fatty acids in an amount sufficient to render the oil emulsifiable in water; and, from about 0.8 vol % to about 3 vol % based on the total volume of the composition of an aliphatic alcohol having from 1 to about 8 carbon atoms.

2. The composition of claim 1 wherein the surfactant comprises from about 12 vol % to about 26 vol % of the composition.

3. The composition of claim 2 including a mixture of surfactants.

4. The composition of claim 3 wherein the mixture of surfactants include sulfonates, naphthenates and fatty acids.

5. The composition of claim 4 wherein the alcohol is isopropanol.

6. The composition of claim 5 including about 0.01 to about 1.0 vol % of an antifoamant.

7. In the machining of cast iron and graphite containing metals wherein an oil-in-water emulsion is used as coolant, the improvement wherein the oil comprises:

a major amount of a base oil consisting of a paraffinic oil of lubricating viscosity;

at least one surfactant selected from the group consisting of sulfonates, naphthenates and fatty, acids in an amount sufficient to render the oil emulsifiable in water; and, from about 0.8 vol % to about 3 vol % based on the total volume of the composition of an aliphatic alcohol having from 1 to about 8 carbon atoms.

8. The improvement of claim 7 wherein the surfactant comprise about 12 vol % to about 26 vol % of the composition and include a mixture of sulfonates, naphthenates and fatty acids.

9. The improvement of claim 8 wherein the alcohol is isopropanol.

* * * * *